United States Patent [19]

Glenn

[11] Patent Number: 4,869,002

[45] Date of Patent: Sep. 26, 1989

[54] VEHICLE ATTACHMENT FOR ACCOMMODATING TOOL

[76] Inventor: Elmer W. Glenn, 728 N. 14th St., Paragould, Ark. 72450

[21] Appl. No.: 233,893

[22] Filed: Aug. 15, 1988

Related U.S. Application Data

[63] Continuation of Ser. No. 4,975, Jan. 20, 1987, abandoned.

[51] Int. Cl.[4] ..... E02F 5/00

[52] U.S. Cl. ..... 37/117.5; 37/DIG. 3; 414/912

[58] Field of Search ..... 37/117.5, DIG. 3, DIG. 12, 37/193, 98; 172/245, 247, 248, 250, 254, 446, 447, 699, 700; 173/29; 175/87; 144/193 A; 414/912, 695

[56] References Cited

U.S. PATENT DOCUMENTS

| | | | |
|---|---|---|---|
| 4,014,175 | 3/1977 | Brink | 37/193 X |
| 4,102,403 | 7/1978 | Steinberg | 172/699 X |
| 4,199,033 | 4/1980 | Van Gundy, Jr. | 37/117.5 X |
| 4,215,496 | 8/1980 | Wehr | 37/117.5 |
| 4,222,186 | 9/1986 | Molby | 37/117.5 X |
| 4,355,477 | 10/1982 | Holmgren et al. | 37/117.5 |
| 4,383,793 | 5/1983 | Weir | 37/117.5 X |

*Primary Examiner*—Clifford D. Crowder
*Attorney, Agent, or Firm*—Walker & McKenzie

[57] ABSTRACT

A digging device especially suited for use on small vehicles, such as pickup trucks, is disclosed. The digging device is operated by a hydraulic pump mounted under the hood of the truck driven by a V belt, a hydraulic pump powered by the power take off, or a hydraulic pump powered by a 12 volt DC motor. The digging device of the present invention also includes a coupling system which permits the device to be quickly attached to the vehicle for digging and quickly detached from the vehicle for conventional use. The device mounts to the frame of the vehicle.

3 Claims, 4 Drawing Sheets

VEHICLE ATTACHMENT FOR ACCOMMODATING TOOL

CROSS-REFERENCE TO RELATED APPLICATION

This is a continuation of my application, Ser. No. 004,975, filed Jan. 20, 1987, entitled "Digging Attachments," now abandoned.

FIELD OF THE INVENTION

The present invention is related to the art of digging devices and more particularly to digging devices which are suitable for use with small vehicles, such as pickup trucks.

SUMMARY OF THE INVENTION

Many different types of digging attachments are known to the art. However, conventional digging attachments are designed to be used with farm tractors or other large vehicles. For example, there are many digging attachments that attach to the three point hitch of a farm tractor. Generally, the attachments are quite expensive, usually require other means of transporting them from job site to job site, and are generally bulky and heavy. There are also digging attachments that attach to larger trucks but again are quite expensive, bulky, and require considerable time to attach and detach.

None of the systems previously mentioned satisfy these needs. This special unit requires ease of attachment or detachment, a transporting system that will not interefere with the vehicles normal driving characteristics, is not heavy or bulky, allowing easier access to certain areas, has a variety of attachments, has controls that swivel 360 degrees, has a digging boom that can be attached in various positions along the main frame, and is less expensive.

The development of such a digging attachment which would satisfy these objects and overcome the difficulties of the prior art would be a significant advance in the technology. Furthermore, the additions of the other features adds to the flexibility of the attachment and would be a further advance in this technology.

Before explaining the invention in detail, it is to be understood that the invention is not limited in its application to the details of construction and the arrangement of the components set forth in the illustrations or descriptions. The invention is capable of other embodiments and of being practiced and carried out in numerous ways. Also, it is to be understood that the phrases and terms utilized herein is for the purpose of description and should not be regarded as limiting.

DESCRIPTION OF A PREFERRED EMBODIMENT

Figure 2:
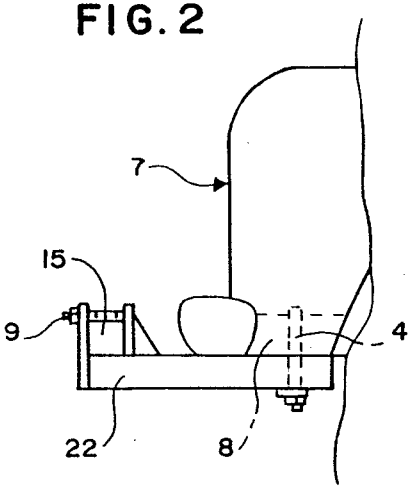
FIG. 2 is a view of a portion of the digging attachment mounting assembly illustrated in FIG. 1.
Figure 3:
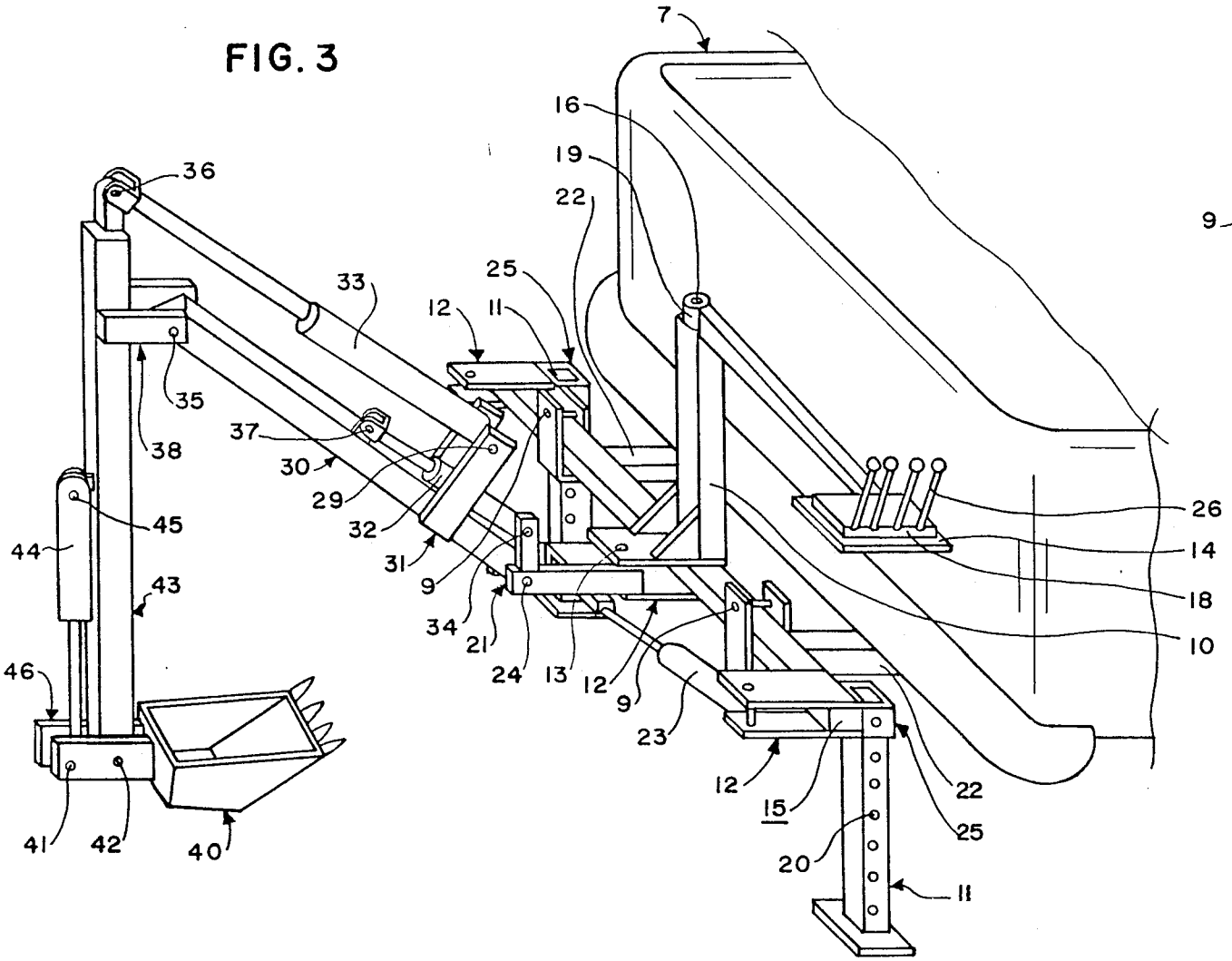
FIG. 3 is a perspective view of a digging attachment embodying the invention and shown as being mounted on a vehicle.

With particular reference to FIGS. 2 and 3 of the drawings a digging attachment (1) is shown as being mounted on the front end of a vehicle. The attachment (1) generally includes a generally horizontal truck mounts (22) bolted to the vehicle frame (8) of the vehicle (7) using the U-bolts (4). The digger frame (15) rests in the cradle of the truck mounts (22) and is held in place by using the bolts (9) to clamp the digger frame (15) into position. By using this type of mounting the digger attachment (1) can be attached to the truck mounts (22) at any point along the dipper frame (15) thus compensating for various distances between different models of truck frames (8). This one of the advantages of this invention, it requires no welding or alterations to the vehicle.

Referring to FIG. 3, welded along the dipper frame (15) are three sets of swivel clevises (12), consisting of two flat steel plates with bored holes in one end of the plates. This allows the boom swivel (21), to be pinned to the swivel clevis (12), with pin (13), at three positions along the digger frame (15). This is another advantage of the digger attachment (1). This allows the boom swivel (21) to be mounted at either end of the digger frame (15), so that the digging attachment (1) can dig parallel to and along side of existing structures. When the boom swivel (21) is moved from one swivel clevis (12) to another, the swing cylinder (23) which is pinned on one end to the boom swivel (21) and pinned on the other end to the swivel clevis (12), must also be moved, one end always being pinned to the boom swivel (21), and the other end pinned to the adjacent swing clevis (12).

Still referring to FIG. 3, connected to the boom swivel (21) using pin (24) is the lower arm (30), which consists of a piece of square tubular steel with two bored holes at each end for the pins (24) and (35). Connected to the lower arm (30) at pin (37) is one end of the lower arm cylinder (32). The other end of the lower arm cylinder (32) is pinned to the boom swivel (21) at pin (34). Welded to the lower arm (30) are two flat steel plates with bored holes in one end. This is the upper arm cylinder mount (31) through which the upper arm cylinder (33) is pinned (29) The other end of the upper arm cylinder (33) is pinned to the upper arm (43) at the pin (36). Welded to the upper arm (43) is the upper arm clevis (38) consisting of two flat steel plates with bored holes in one end through which the upper arm clevis (38) is pinned to the lower arm (30) at pin (35). Connected to the upper arm (43) at pin (45) is one end of the bucket cylinder (44). The other end of the bucket cylinder (44) is connected to the bucket clevis (46) by means of a pin (41). The bucket clevis (46) is also pinned to the upper arm (43) at pin (42). The bucket clevis (46) consists of two flat steel plates welded to the bucket (40), the flat steel plates with bored holes for pins (41) and (42).

Further referring to FIG. 3, welded on each end of the digger frame (15) are the outrigger guides (25) through which the outriggers (11) can slide vertically and be pinned at various positions through the outrigger pin holes (20).

Also welded to the digger frame (15) as shown in FIG. 3, is the vertical support (10). The vertical support (10) is a length of square tubular steel with a cylindrical threaded pipe welded at the top to be used as the hydraulics fill plug (16). To the pipe (19) is welded the controls mount (14). This allows the controls (18) to be swiveled 360° by using the swivel (19). This is still another advantage of the digging attachment (1) so as the operator can swivel the controls (18) to any position fro better visibility and convenience.

Figure 1:
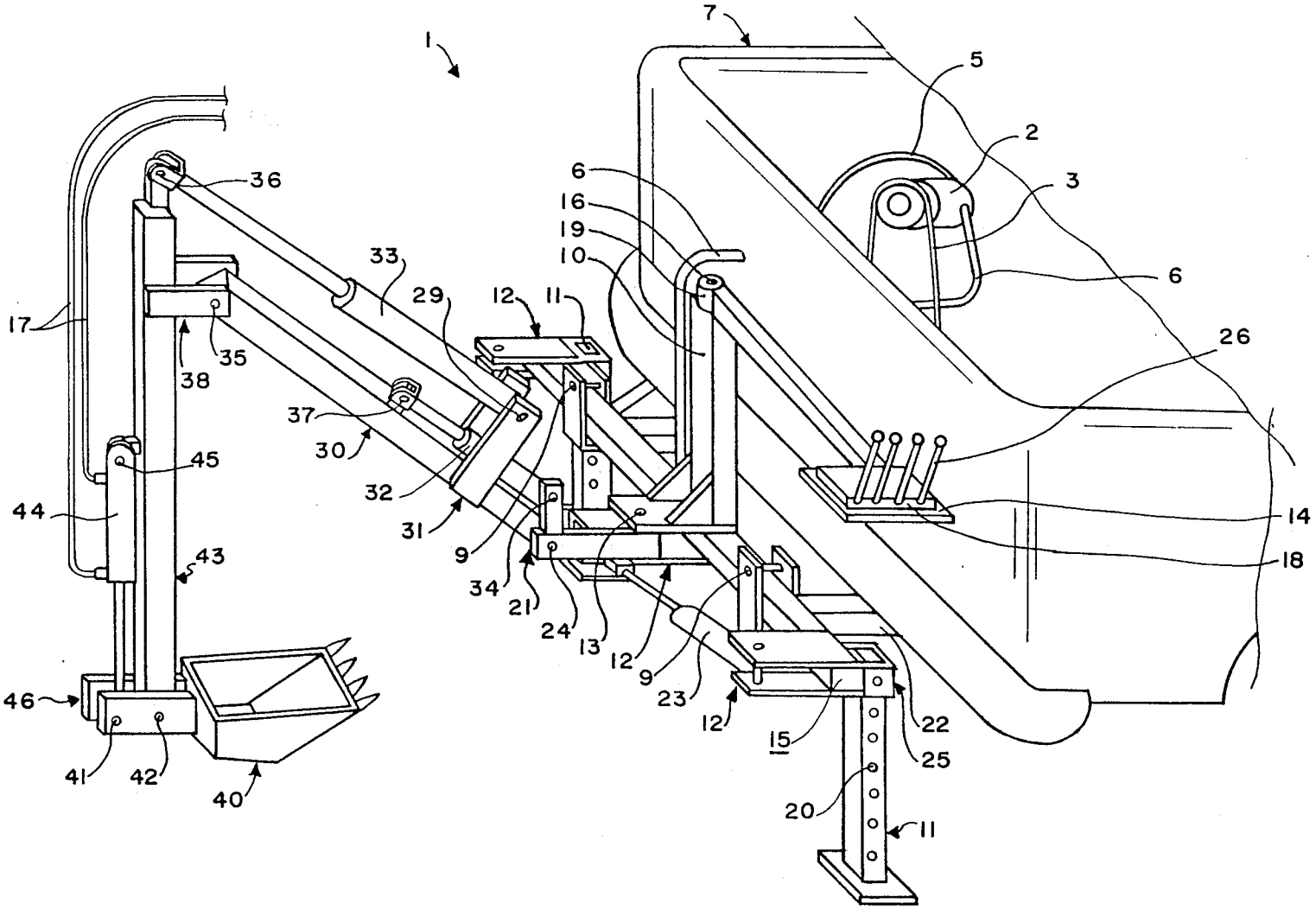
FIG. 1 is a perspective view of a digging attachment embodying the invention and shown as being mounted on a vehicle and illustrating the hydraulics that power the attachment.

Referring now to FIG. 1, this is an illustration of the hydraulics that are used to power the digging attachment (1). In this illustration a hydraulic pump (2) that is driven by a V belt (3) is used. The digger frame (15) is used as the oil reservoir. A supply hose (5) is connected at one end of the digger frame (15) and is connected to the other end to the hydraulic pump (2). The hydraulic pump (2) pumps the oil through the pressure hose (6) to the hydraulic controls (18). By pushing or pulling the control handles (26), the hydraulic oil is allowed to flow through the hoses (17), to each individual cylinder, thus causing the cylinders to extend or retract and thereby operating the corresponding components.

Figure 4:
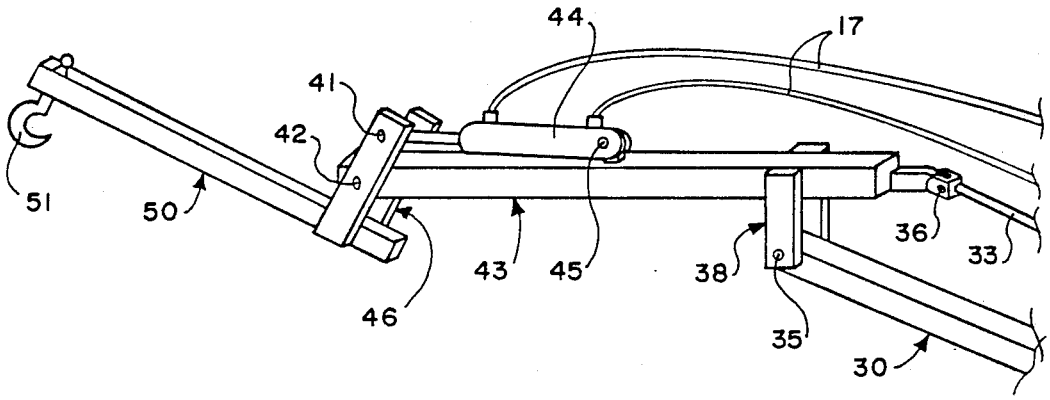
FIG. 4 is a view of a portion of the digging attachment illustrating the use of a lifting arm attachment.

In reference to FIG. 3, by removing pins (41) and (42), the bucket (40) can be removed. Now referring to FIG. 4, a lifting arm (50) can be connected in the place of the bucket (40) and the lifting arm (50) used to lift heavy objects by use of the lifting arm hook (51). This is accomplished by operating one of the control handles (26) in FIG. 1 to activate the bucket cylinder (44) thus pivoting the lifting arm (50) around pin installation (42).

Figure 5:
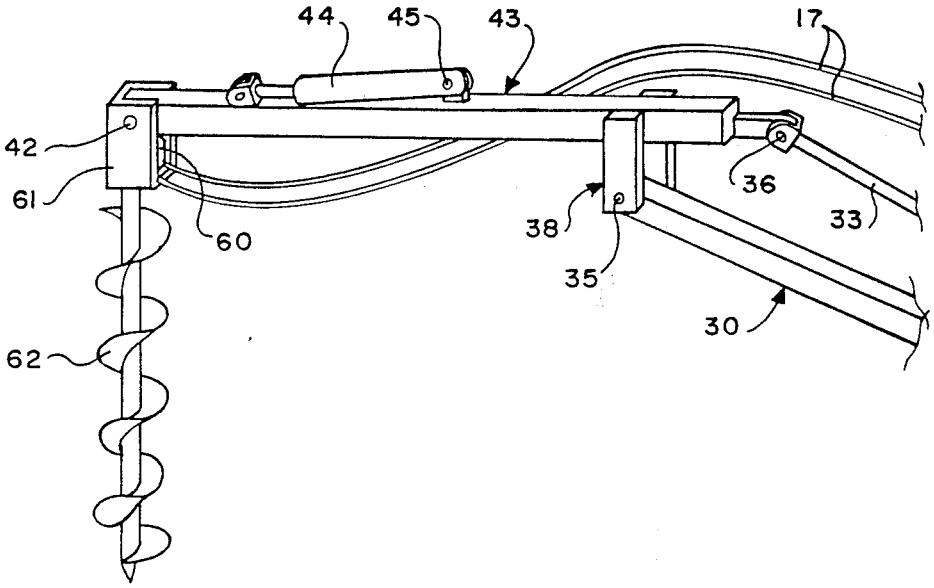
FIG. 5 is a view of a portion of the digging attachment illustrating the use of an earth boring attachment.

Again referring to FIG. 3, by removing pins (41) and (42), the bucket (40) can be removed. Referring now to FIG. 5, the earth boring auger can be pinned to the upper arm (43) by inserting in (42) through the hydraulic motor mount (61) and the bored hole in the end of the upper arm (43). The hoses (17) are disconnected from the upper arm cylinder (44) and connected to the hydraulic motor (60) which is attached to the earth boring auger (62) By operating one of the handles (26) in FIG. 1, the hydraulic motor (60) can be caused to rotate thus using the auger to bore a hole in the earth.

Figure 6:
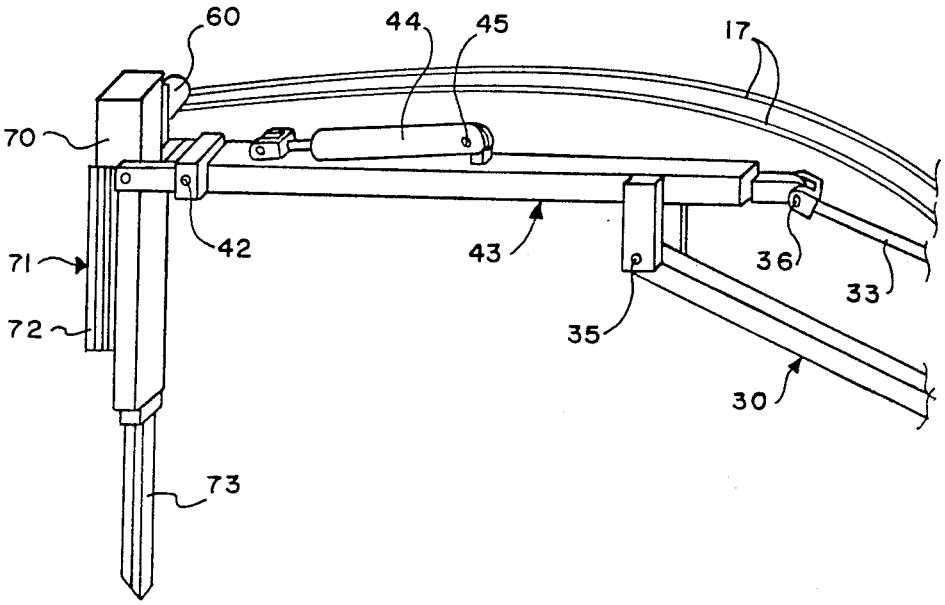
FIG. 6 is a view of a portion of the digging attachment illustrating the use of a post driving attachment.

Again in FIG. 3, pins (41) and (42) are removed and the bucket (40) is removed. The post driver (71), in FIG. 6, can be attached to the upper arm (43) by using the pin (42). The hoses (17) are once again disconnected from the upper cam cylinder (44) and connected to the hydraulic motor (60). By operating one of the control handles (26) in FIG. 3, the hydraulic motor can be caused to rotate. This action turns the sprocket (72), thus lifting the weight (70) and then releases the weight (70), letting it fall on the post (73), thus driving the post (73) into the earth.

Figure 7:
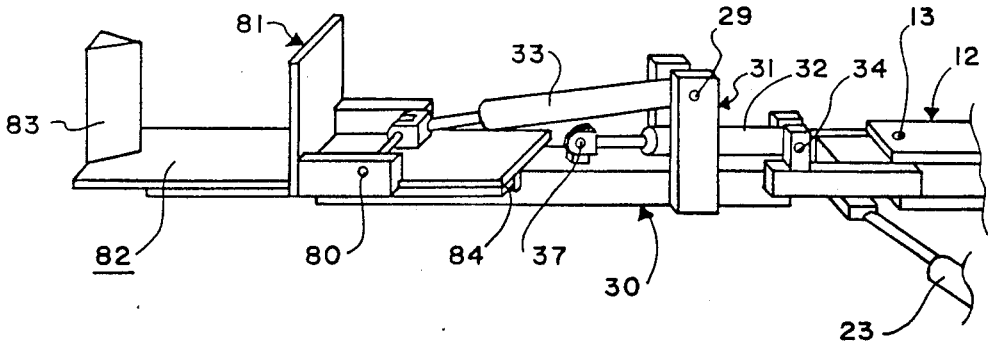
FIG. 7 is a view of a portion of the digging attachment illustrating the use of a log splitting attachment.

The final illustration, FIG. 7, is a log splitting attachment. Referring to FIG. 3, pins (36) and (35) are removed and the upper arm (43) is removed. The log splitter platform (82) is then pinned to the lower arm (30) using pin (84). The lower arm cylinder (33) is attached to the slide (81) using pin (80). A log is placed between the slide (81) and the wedge (83). By operating one of the control handles (26) in FIG. 3, the upper arm cylinder (33) will extend causing the slide (81) to push the log against the wedge (83), thus splitting the log. The control handle (26) is then operated in the opposite direction causing the lower arm cylinder (33) to retract so another log can be inserted between the slide (81) and wedge (83).

This is another advantage of this invention, the versatility and flexibility of the various attachments.

Various features of the invention are set forth in the following claims:

We claim:

1. An attachment adapted to be mounted to a vehicle for accommodating one of a plurality of tools including a digging bucket, a log splitter, a lifting arm, a post driver or an earth boring auger, said attachment comprising:

a plurality of horizontal vehicle mounts attached by means of fasteners to the underneath of the front of said vehicle and extending forwardly from said vehicle to form a cradle for receiving a horizontal frame member;

a horizontal frame member resting in said cradle and held in place by fasteners;

three sets of swivel clevises mounted to said horizontal frame member for receiving a boom swivel or a swing cylinder;

a boom swivel selectively mounted in any one of said three sets of swivel clevises with a swing cylinder mounted in one of the remaining sets;

a boom arm having one end pivoted to said boom swivel and adapted to selectively mount one of said plurality of tools.

2. An attachment adapted to be mounted to a vehicle for accommodating one of a plurality of tools including a digging bucket, a log splitter, a lifting arm, a post driver or an earth boring auger, said attachment comprising:

a plurality of horizontal vehicle mounts bolted by means of U-bolts to the underneath of said vehicle and extending outwardly from said vehicle to form a cradle for receiving a horizontal frame member;

a horizontal frame member resting in said cradle and held in place by bolts;

a plurality of swivel clevises mounted to said horizontal frame member for receiving a boom swivel or a swing cylinder;

a boom swivel selectively mounted in any one set of said swivel clevises with a swing cylinder mounted in one of the remaining sets;

a boom arm having one end pivoted to said boom swivel and adapted to selectively mount one of said plurality of tools.

3. An attachment adapted to be mounted to a vehicle for accommodating one of a plurality of tools including a digging bucket, a log splitter, a lifting arm, a post driver or an earth boring auger, said attachment comprising:

a plurality of horizontal vehicle mounts attached by means of fasteners to the underneath of said vehicle and extending outwardly from said vehicle to form a cradle for receiving a horizontal frame member;

a horizontal frame member resting in said cradle and held in place by fasteners;

a plurality of swivel clevises mounted to said horizontal frame member for receiving a boom swivel or a swing cylinder;

a boom swivel selectively mounted in any one set of said swivel clevises with a swing cylinder mounted in one of the remaining sets;

a boom arm having one end pivoted to said boom swivel and adapted to selectively mount one of said plurality of tools.

* * * * *